US006966723B2

(12) United States Patent
Zentner

(10) Patent No.: US 6,966,723 B2
(45) Date of Patent: Nov. 22, 2005

(54) BINDER/AGGREGATE/CONTAINER SYSTEMS

(76) Inventor: Robert K. Zentner, 1320 N. State Pkwy., #12-B, Chicago, IL (US) 60611

( * ) Notice: Subject to any disclaimer, the term of this patent is extended or adjusted under 35 U.S.C. 154(b) by 147 days.

(21) Appl. No.: 10/643,791

(22) Filed: Aug. 19, 2003

(65) Prior Publication Data

US 2004/0033383 A1 Feb. 19, 2004

Related U.S. Application Data

(63) Continuation-in-part of application No. 09/996,028, filed on Nov. 15, 2001, now abandoned.

(51) Int. Cl.[7] ..... E01C 7/00; E01C 11/00

(52) U.S. Cl. ..... 404/17

(58) Field of Search ..... 404/17, 72, 79–81, 404/83, 92, 95, 101, 107

(56) References Cited

U.S. PATENT DOCUMENTS

| | | | | | |
|---|---|---|---|---|---|
| 1,512,389 | A | | 10/1924 | Wylie | |
| 1,546,185 | A | | 7/1925 | Andresen | |
| 2,988,207 | A | | 6/1961 | Lovelace | |
| 3,577,976 | A | * | 5/1971 | Heller | 126/343.5 A |
| 3,633,563 | A | * | 1/1972 | Osborn et al. | 126/343.5 A |
| 4,418,681 | A | * | 12/1983 | Moody | 126/343.5 R |
| 4,445,848 | A | * | 5/1984 | Heller | 432/13 |
| 4,511,284 | A | | 4/1985 | Sterner | |
| 4,678,363 | A | | 7/1987 | Sterner | |
| 4,695,186 | A | * | 9/1987 | King | 404/111 |
| 4,704,046 | A | * | 11/1987 | Yant | 404/109 |
| 5,120,217 | A | * | 6/1992 | O'Brien et al. | 432/120 |
| 5,201,472 | A | * | 4/1993 | Brock | 241/22 |
| 5,291,876 | A | * | 3/1994 | Milstead | 126/343.5 A |
| 5,307,608 | A | | 5/1994 | Muir et al. | |
| 5,333,969 | A | | 8/1994 | Blaha et al. | |
| 5,344,485 | A | * | 9/1994 | Glynn, Jr. | 106/281.1 |
| 5,452,800 | A | | 9/1995 | Muir | |
| 5,580,211 | A | * | 12/1996 | Mengel | 414/812 |
| 5,765,686 | A | | 6/1998 | Wright et al. | |
| 5,988,935 | A | | 11/1999 | Dillingham | |
| 5,992,628 | A | | 11/1999 | Vermillion et al. | |
| 6,007,419 | A | * | 12/1999 | Bessire | 454/118 |
| 6,315,492 | B1 | * | 11/2001 | McIntosh | 404/17 |

* cited by examiner

*Primary Examiner*—Thomas B. Will
*Assistant Examiner*—Alexandra Pechhold
(74) *Attorney, Agent, or Firm*—Dorr, Carson, Sloan, Birney & Kramer, P.C.

(57) ABSTRACT

A road repair kit and/or bridge joint repair kit is comprised of an outer container, a measured amount of binder material and a separate and distinct measured amount of aggregate material. In one preferred embodiment of this invention, the binder material is in a first consumable container (meltable bag) and the aggregate material is, likewise, in a second consumable container (meltable bag) inside the first consumable container. In another preferred embodiment, both the binder and the aggregate are contained in the same consumable container (meltable bag).

4 Claims, 8 Drawing Sheets

BINDER/AGGREGATE/CONTAINER SYSTEMS

RELATED APPLICATIONS

This application is a continuation-in-part of U.S. patent application Ser. No. 09/996,028 filed Nov. 15, 2001 entitled "Asphalt Container Systems" now abandoned.

BACKGROUND OF THE INVENTION

1. Field of the Invention

The present invention generally relates to binder/aggregate/container systems for effecting road surface and/or bridge joint repairs. More specifically this invention relates to those binder/aggregate/container systems that employ polymeric materials e.g., petroleum-derived asphaltic materials, synthetic polymers such as those of propylene, ethylene-propylene copolymers, butylenes copolymers and the like—as well as mixtures thereof—as binder materials.

2. Description of Related Art

In the road surface and/or bridge joint repair industry, those binder components and aggregate components used to repair cracks, potholes and bridge joint breaks are usually shipped to a job site in one of two ways. In the first way, a load (often a pallet-sized load) of individual packages of a binder material are shipped to a job site. Similarly, a load (again, often a pallet-sized load) of individual packages of one or more aggregate materials are shipped to the job site. Ideally, a certain number of packages of binder material and a certain number of packages of the aggregate material are removed from their respective pallets, unwrapped and their contents placed in a melter unit. The certain numbers of respective packages is intended to create a mixture having a certain desired ratio of binder material to aggregate material. Unfortunately, job-site mistakes are made in getting the right number of packages of each type of ingredient into the melter. This results in binder material/aggregate material repair compositions that have too much or too little of the binder material relative to the aggregate material.

The second way that asphaltic components and aggregate components are shipped to a job site is in the form of packaged blocks of a mixture of the binder component(s) and the aggregate component(s). A desired binder to aggregate ratio can thereby be maintained. These mixture blocks are, however, relatively expensive to make and use. This follows from the fact that the binder component must be melted at the factory (at a considerable fuel expense) and the aggregate component thoroughly mixed into the melted binder material. The resulting binder material/aggregate material mixture or composite is then placed in containers where the binder component cools and solidifies. Those skilled in this art also will appreciate that package materials have been developed that, in effect, eliminate the need to remove or dispose of the outside container. One type of such a package is disclosed in, e.g., U.S. Pat. Nos. 5,452,800 and 5,307,608. They teach binder packages employing thin, meltable, polypropylene films as the sole containment means—and methods for their manufacture.

U.S. Pat. No. 5,992,628 teaches an binder/package system comprised of an binder composition surrounded by a container made of a meltable material. That is to say that the container is melted along with the binder when the package is put into those gas fired melter units typically used at job sites. The container is made of a composition comprised of about 40–90% of an asphaltic material and about 10–60% of a synthetic polymer such as propylene, ethylene-propylene, methacrylates and the like. The container has various physical features e.g., handles, breakage channels for dividing the binder into fractional submits such as one half, one quarter and so on.

U.S. Pat. No. 5,765,686 also teaches packaging binder materials in consumable packages made of binder/polymer compositions. Such packages are provided with fraction creating (e.g., one half, one quarter, etc.) breakage line indentations molded into the material from which the composition is made. A thin, meltable, polymer film (e.g., polypropylene), is used to provide outside protection for the package.

U.S. Pat. No. 2,988,207 ("the '207 patent") teaches a package system for ready mix concrete. Its sand, or sand and gravel, components (or other materials) are contained in a paper outer paper bag. A smaller, moisture sealed, plastic bag, filled with dry cement, is placed inside the paper bag. The contents of the outer bag (sand, gravel) as well as the cement contents of the inner bag (cement) are premeasured to their proper proportions. They are mixed with water at the job site to produce a concrete forming composition.

U.S. Pat. No. 4,678,363 teaches a road repair truck having an aggregate hopper and a binder hopper. The aggregate hopper has a conveyor and a discharge chute for receiving the aggregate and directing it downwardly. A discharge outlet on the chute dispenses the aggregate to a pothole, etc. while a binder composition is sprayed on to the aggregate as it is being dispensed. To this end, the chute is provided with a rotatable hollow shaft that extends below the outlet of the aggregate discharge chute. A projection is mounted on the periphery of the hollow shaft in order to better mix the aggregate that is moving downwardly through the discharge chute. A plate device is attached to the hollow shaft to make the aggregate swirl and flare outwardly as it drops downwardly to the road surface. Again, the binder is sprayed on the swirling aggregate just as it leaves the discharge chute (i.e., but before it reaches the roadway).

U.S. Pat. No. 1,546,185 ("the '185 patent") teaches a road repair vehicle having partitioned road repair ingredient sections. A heating box is positioned between the partitions. Heat from a heater box is circulated through a casing system in order to heat the as yet unmixed road repair materials.

U.S. Pat. No. 5,333,969 teaches an automated repair vehicle in which computer controls direct the mixing of desired amounts of various road repair composition ingredients.

U.S. Pat. No. 5,988,935 teaches a road repair vehicle having a self-contained heating box. The binder used by this vehicle is not heated separately from the aggregate.

U.S. Pat. No. 1,512,389 teaches a road repair vehicle having different compartments such that all of the road repair compositions are heated separately.

U.S. Pat. No. 4,511,284 ("the '284 patent") shows a pothole repair unit in which asphalt is heated separately from the separate aggregate. The heated aggregate particles are then coated with the heated asphalt.

These patents fall into two broad categories (1) those devoted to generalized packaging methods (for binder and aggregate materials, as well as for other materials such as concrete ingredients) and (2) those devoted to binder material (e.g., asphalt) dispensing vehicles. The packaging method patents (e.g., the '628 patent and the '686 patent) generally teach use of "consumable" containers. That is to say an asphalt/polymer container and its asphalt or asphalt/polymer contents are thrown in a melter as a unit. These containers also may be partially divided or compartmentalized. This is done for the purpose of breaking these containers (and their binder contents) into smaller sizes (e.g., one half, one quarter, etc.) at a job site. It should be specifically noted however that these compartmentalized binder packages do not contain two distinct kinds of ingredients (e.g., a separate and distinct binder ingredient, and a separate and distinct aggregate ingredient, etc.), but rather contain a body of a composite material (a solidified mixture of asphalt/polymer and aggregate).

The '207 patent teaches a container having two distinct compartments containing two different materials. This system is not, however, concerned with asphalt related products. Rather, it is concerned with packaging a cement/sand (or sand and gravel) system that will be used to make concrete. The cement absolutely can not be allowed to come into contact with moisture before it is mixed with the aggregate. Hence, it is placed in a tightly sealed, moisture proof, plastic bag that resides in a second, layered paper, bag that contains the sand (or sand and gravel) ingredient(s). At the time of use, the two bags are broken, the materials are mixed with each other and water is added to the mixture to produce a wet concrete mixture that is poured into a form and allowed to dry in that form.

Thus, none of the above noted patents teach a binder/aggregate container system that has a binder material component (such as an asphaltic/polymer composition) that substantially constitutes a separate and distinct material relative to an aggregate component that also resides in the same container. Such binder/aggregate compartmentalization is found only in those patents concerned with asphalt laying machines. These patents generally teach heating the separated ingredients at the same time, although not necessarily to the same degree. For example, the vehicle described in the '363 patent has a first hopper for containing an aggregate material and a second hopper for containing an additive material. Similarly, the vehicle described in the '284 patent shows a hopper that holds and dispenses aggregate, while a separate and distinct tank holds a road patching, asphaltic material. The '185 patent teaches a system wherein a heater is placed between a bituminous material tank and an aggregate hopper. The heater is used to heat these two materials in a differential manner. The system is particularly concerned with assuring that the aggregate component is sufficiently heated.

In contrast with the teachings of all of the above patents, applicant has found that if a body of binder material such as an asphaltic and/or synthetic polymeric material is introduced into a melter—as a substantially distinct body (as opposed to being in the form of a binder/aggregate mixture)—it will more readily melt relative to a homogeneous mixture or composite of the same binder material and the same aggregate material. Comparatively speaking, applicant has found that road and/or bridge repair processes based upon throwing a substantially separate and distinct body of binder material and a substantially distinct body of aggregate into a given melter unit is (especially, from a heat efficiency point of view) a better process than throwing a body of thoroughly mixed or otherwise composited binder and aggregate into that same melter unit under comparable heating conditions. Assuring that these two distinct materials are used in the proper proportions adds to the utility of the product created by subsequently thoroughly mixing these two ingredients. Thus, applicant has developed road repair systems or kits that serve to assure that a binder ingredient is introduced into a melter as a body that is substantially distinct from an aggregate ingredient body that is also introduced into that same melter unit. In one particularly preferred embodiment of this invention, the distinct body of aggregate material is embedded in a body of binder material. In another particularly preferred embodiment, a meltable bag is first placed in a container of a defined size and configuration such as a box having a square or rectangular cross sectional configuration. A predetermined amount of aggregate is then put into the meltable bag. Thereafter, a predetermined amount of the binder is placed on the aggregate. The binder can be in the form of one or more solid blocks or, in the alternative, the binder is in a fluid, that is to say liquid or semi-liquid state, so that it can be poured over the top layer(s) of the aggregate particles and then allowed to cool, and hence solidify. In another somewhat less preferred embodiment, the binder is placed in the meltable bag first and the aggregate placed over the binder. In either case, however, there should be a fairly well defined body of aggregate-free binder and a fairly well defined body of binder-free aggregate. These kits also will serve to assure that proper proportions of aggregate and binder are employed.

SUMMARY OF THE INVENTION

The present invention as a packaging embodiment and a method of use embodiment. The packaging embodiment involves the fact that an overall road or bridge joint repair material/packaging system (a "kit") is comprised of: (1) a predetermined amount of a binder component (e.g., an asphaltic component and/or a synthetic polymeric component that is housed within an outside container, (2) a predetermined amount of an aggregate component that is housed within the same outside container and (3) an outside container that houses both the binder component and the aggregate component. In another particularly preferred embodiment, the system or kit further comprises a meltable bag that contains both the binder and the aggregate materials. This meltable bag is contained in the outside container. In another preferred embodiment of this invention the outside container is made of a meltable polymer material.

In yet another preferred embodiment of this invention, a "distinct" body of binder material encapsulates a distinct body of aggregate material (i.e., the two materials are not however homogenously mixed). The resulting binder/aggregate body can be placed in a bag (e.g., a meltable bag) which, in turn, is placed in an outside container (e.g., a box made of cardboard, a polymer material, including a meltable polymer material or wood) having a given size and configuration such as a box having a square or rectangular configuration. Such a container also will preferably be made of a rigid material such a cardboard, a polymeric material, wood and the like. Again, in the case of polymeric containers, the polymeric material used to make the outside container may itself be a meltable material. Hence, the entire container can be readily thrown into a job-site melter unit. It also should be appreciated that when the outside container is made of a meltable material there may be no need for a meltable bag in the system. That is to say that such a kit may be comprised of a meltable container in which a predetermined amount of aggregate and a predetermined amount of binder are separately placed, e.g., (1) a layer of binder can be placed on top of a layer of aggregate, (2) a layer of aggregate placed on top of a layer of binder or (3) a container having two distinct compartments for the two distinct road/or bridge joint repair composition components. In all cases, the binder material may be placed in the contained in the form of a solid block of binder material (or multiple blocks of solid binder material); or the binder may be poured into the container in a liquid or semi-liquid form and then allowed to cool and, hence, solidify. The viscosity of the liquid or semi-liquid to be poured may be controlled by known methods of heating the binder material and/or allowing it to cool. Preferably, the temperature of the binder will not be sufficient to melt any bag employed in the system.

Obviously, if the binder is placed in a meltable bag or a meltable container in the form of a solid block (or in the form of from about 2 to about 10 solid blocks) there will be a relatively sharply defined interface between the solid block (or blocks) and the aggregate material. On the other hand, if a binder material is heated to a fluid state (i.e., heated to a liquid or semi-liquid state) and poured over a body of aggregate in a meltable bag (or meltable container), there will be a less sharply defined interface between the binder and aggregate components when the binder cools and solidifies. That is to say that in the case where a liquid or semi-liquid binder is employed, there will be a certain amount of mixing of the top layer(s) of aggregate particles and a liquid or semi-liquid binder that is poured upon said top layer of aggregate particles. Generally speaking, the more liquid (less viscous) the binder material, the deeper it will penetrate into the top layer(s) of aggregate particles. Similarly, if the aggregate were dispensed upon a body of liquid or semi-liquid binder, some of the bottom layer(s) of aggregate would penetrate into and be coated by, and/or immersed in, the binder material.

Nonetheless, when a liquid or semi-liquid binder is poured over a body of aggregate—or when a body of aggregate is poured over a body of liquid or semi-liquid binder—the resulting body will be comprised of a first portion that is substantially all binder, a second portion that is substantially all aggregate and a third portion wherein the binder and aggregate are of a mixed nature. That is to say that in an interface region between the body of aggregate and the body of binder there will be a region or layer wherein some or all of the aggregate particles near the top (or bottom) aggregate surface will be partially or fully coated with (or immersed in) the liquid or semi-liquid binder material.

Since, under the general teachings of this invention, it is preferred to keep the binder body as distinct ("pure") as possible in order to more effectively melt it, any binder/aggregate interface region containing partially coated (or immersed) aggregate particles will preferably contain less than 40% of the total amount of binder material contained in the overall binder/aggregate system. More preferably, the binder/aggregate interface region will contain less than 20% of the total binder material employed in the road or bridge joint repair kits of this patent disclosure. Kits having less than 10% of their total binder component involved in coating and/or immersing aggregate particles are even more preferred.

The relative proportions of the binder component to the aggregate component are such that the binder component will constitute from about 18 weight percent to about 90 weight percent of the binder component/aggregate component combination. Conversely, the aggregate component can constitute from about 10 weight percent to about 82 weight percent of the binder component/aggregate component combination. The weight of the packaging material itself is not considered in the above presentation. Generally speaking however, the packing component will constitute from about 1 to about 5 percent of the weight of the overall binder component/aggregate component/packaging component combination.

In some of the more preferred embodiments of this invention, the binder component will be comprised of an overall binder material and an additive material. In such systems, the binder material will constitute from about 15 to about 90 weight percent of the binder component/additive component system. Thus, the additive material may constitute from about 10 weight percent to about 85 weight percent of the binder component/additive component combination. In some cases such additives may be mixed into the aggregate component.

Asphaltic binder materials preferably will be mixtures of bitumens, especially those obtained as the residue product of petroleum refining operations. Generally speaking such bitumens are mixtures of paraffinic and aromatic hydrocarbons and various heterocyclic compounds containing sulfur, nitrogen and oxygen. The additive material(s) will generally be synthetic elastomers, polymers, antioxidants, modifiers and/or reinforcing agents. These additive materials may, for example, be made from fibers, reclaimed tire rubber, polyester, fiber glass, cellulose and/or carbon black. The aggregate component(s) of the binder component/aggregate component combination will generally be comprised of particulate materials and preferably those having average diameters ranging from about 2 millimeters to about 37.5 millimeters. Particularly preferred aggregate materials for the practice of this invention will include basalt, granite and/or limestone particles.

Again, in one of the most preferred embodiments of this invention, the aggregate component will be at least one separate and distinct body of aggregate material located substantially within at least one body of the binder component. That is to say that such an aggregate component is not uniformly or homogeneously mixed into the binder component, but rather is preferably placed in a container (bag, box, etc.) which is then at least partially surrounded by the binder material. The binder material also can be particulate in nature, or it can be a unitary mass formed by at least partially immersing the aggregate material in a liquid form (molten) of the binder material and then allowing the binder material to cool, hence, and solidify around the body of the aggregate material (and its container). In yet another particularly preferred embodiment of this invention, the road or bridge joint repair material/package systems or kits will be comprised of a bag of aggregated material that is located in an overall container bag (that contains both the aggregate component and the binder component) which, in turn, is located in an outside container such as a box made of cardboard, a polymer material (including a meltable polymer material) or wood.

In other particularly preferred embodiments of this invention, the binder component and the aggregate component are each respectively contained in a container made of a meltable polymeric material. That is to say that the binder component need not be contained in a container bag that also contains a bag of aggregate material. In cases where the binder material is in the physical form of pellets or particles rather than in the form of a block (or several blocks), it is preferred that said pellets be contained in their own separate and distinct container and/or in the overall container bag. In still another preferred embodiment of this invention, a first inner container for the binder aggregate component and a second inner container for the binder component each will be bag-like containers while the outer, overall container is a box-like container. In still other preferred embodiments of this invention, the first and second inner containers will be made of a consumable polymer material (i.e., a polymer material capable of being melted under those temperatures capable of melting the binder materials contained in the kits). The first and second inner containers (e.g., plastic bags) contained in the outer container (box-like container) are simply thrown into a melter unit while residing in their respective meltable bags. Thus, the "proper" amounts of binder and aggregate are delivered to the jobsite melter unit. Hence, job-site measuring mistakes concerning the relative amounts of the two main ingredients are far less likely to occur.

In yet another preferred embodiment of this invention, the outside container also will be made of a consumable polymer material as well. In other embodiments, however, the outer container (e.g., one made of cardboard, non-meltable polymer materials or wood) is opened, and thereafter disposed of as trash rather than being placed in a melter unit. In all such embodiments of the hereindescribed invention, however, the body of binder material in the overall container has more of an opportunity to at least partially melt before it is thoroughly mixed with the aggregate material with which the binder material is subsequently thoroughly mixed (e.g., mixed by a stirring action provided by a jobsite melter unit).

Again, this invention is based in large part upon applicant's finding that if a body of binder material such as asphaltic and/or polymeric materials (e.g., propylene, ethylene-propylene, metharcylates, synthetic elastomers, and the like) is (are) introduced into a job site melter unit, as a distinct body or predominantly distinct body (e.g., greater than 60% distinct from the aggregate material), the binder material will more readily melt relative to a process wherein a mixture (or other composite) of the same binder material and the same aggregate is (are) introduced in the melter as a more or less homogeneous mixture. Again, comparatively speaking, applicant has found that the process of throwing a bag of binder and a bag of aggregate into a given melter is a better process than throwing a bag of thoroughly mixed binder and aggregate into that same melter. That is to say that applicant has found that under field conditions an binder component is melted faster and with less heat consumption (and hence less expense) if it is not mixed with the aggregate, relative to the time and heat quantity required to heat a completely or substantially blended mixture of particles of an binder material and particles of an aggregate material. This is the case whether the mixture is comprised of distinct particles of binder materials and distinct particles of aggregate, or in the case where the mixture is a block of composite material formed by first melting the binder material and then mixing aggregate materials into the melted binder material and then letting the resulting mixture solidify into a composite, monolithic, body. Based upon these findings, applicant has developed certain hereafter more fully described kits that assure that the binder ingredient is introduced into the melter as a substantially unified body (i.e., not homogenously mixed with an aggregate ingredient) and such that the desired binder material/aggregate material ratios can be more readily employed.

DETAILED DESCRIPTION OF THE INVENTION

Figure 1:
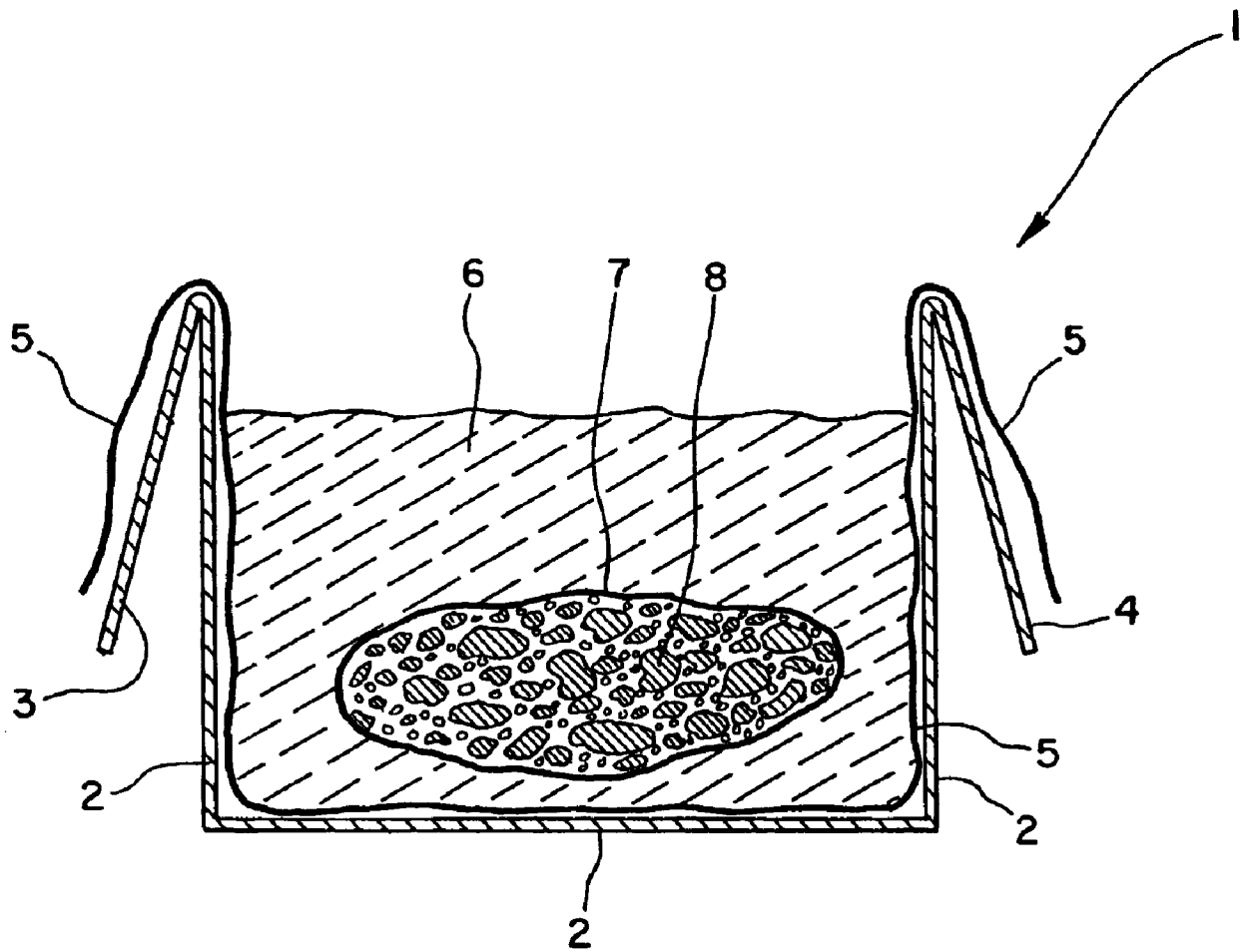
FIG. 1 is a cut-away side view of an embodiment of this invention wherein a body of aggregate material is embedded in a body of asphaltic material.

FIG. 1 depicts one particularly preferred embodiment of this invention wherein a container/ingredient system 1 for applicant's road surface repair kit or bridge joint repair kit is placed in a first or outside container 2 (e.g., a cardboard box, polymer box, wooden box, etc.) having one or more lid flaps 3, 4, etc. In this embodiment, this outside container 2 generally serves to contain a second or inner container 5. This inner container 5 is most preferably in the form of a bag made of a meltable polymeric material. That is to say that the inner container is capable of being melted under those conditions that will melt a binder material (e.g., an asphaltic and/or other polymeric material, etc.) contained in said inner container. This inner container holds a body of binder material 6 that can be in a block form (such as that depicted in FIG. 1) or in the form of a bag of granular binder material. Regardless of its physical form, the body of binder material 6 will preferably at least partially encapsulate a third container 7. This third container 7 contains a measured portion of an aggregate material 8. The third container also is most preferably in the form of a bag made of a meltable polymeric material. If the outside container 2 is itself made of a meltable polymeric material, the outside container 2 and its entire contents can be thrown into a jobsite melter unit. If the outside container is made of cardboard, non-meltable polymer, wood or some other nonmeltable material, the inner container 5 is removed from the outside container 2 and placed in the melter unit and the outside container disposed of as trash.

Figure 2:
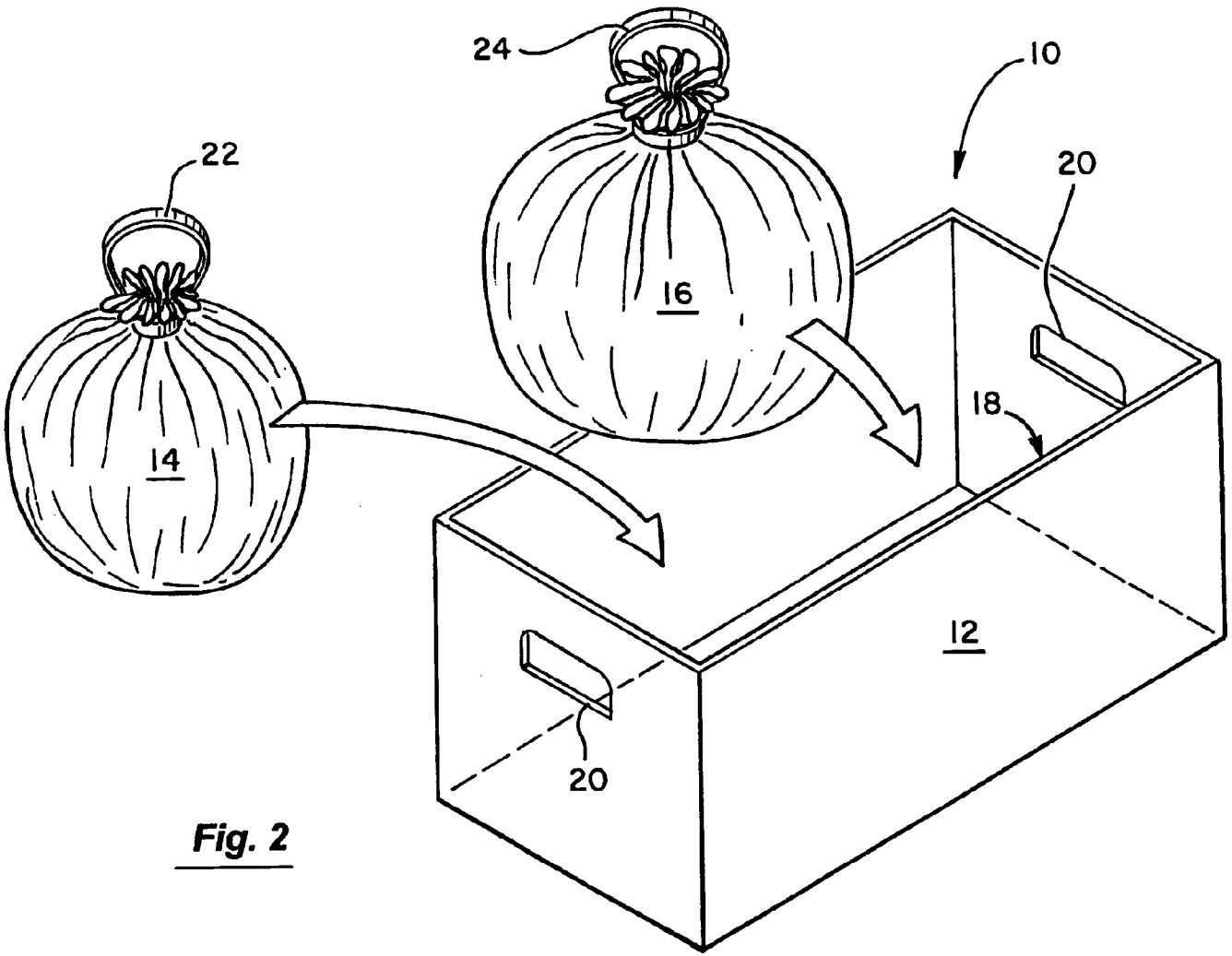
FIG. 2 is a perspective view of an embodiment of this invention wherein an inner container of asphaltic material and an inner container of aggregate material are placed in an outer container.

FIG. 2 depicts another container system 10 for applicant's road surface repair and/or bridge joint repair kits. The system 10 is comprised of an outer container 12, a first inner container 14 for holding a measured amount of binder material and a second inner container 16 for holding a measured amount of an aggregate material. The top 18 of the container 12 is preferably provided with a lid (not shown) and handles 20 for lifting the outer container 12 by hand. The first container 14 can likewise be provided with one or more handle(s) 22. Similarly, the second container 16 can be provided with one or more handle(s) 24. In a particularly preferred embodiment of this invention, the first inner container 14 (and its handles 22, if any), the second inner container 16 (and its handles 24, if any) and/or the outer container 12 all will be made of meltable polymeric materials. Preferably such materials will preferably melt at road repair melter unit operating temperatures (e.g., above about 150° F. and up to about 400° F.).

Since, these containers 12, 14 and 16 are likely to be lifted and otherwise handled by workers at a jobsite, their weight should be suitable for such lifting and handling by such workers. For example, applicant prefers the outside container 12 and its contents (e.g., first container 14 and its asphaltic contents and second container 16 and its aggregate contents) be, in total, less than about 60 pounds. Systems weighing between about 30 and 50 pounds are even more preferred.

Figure 3:
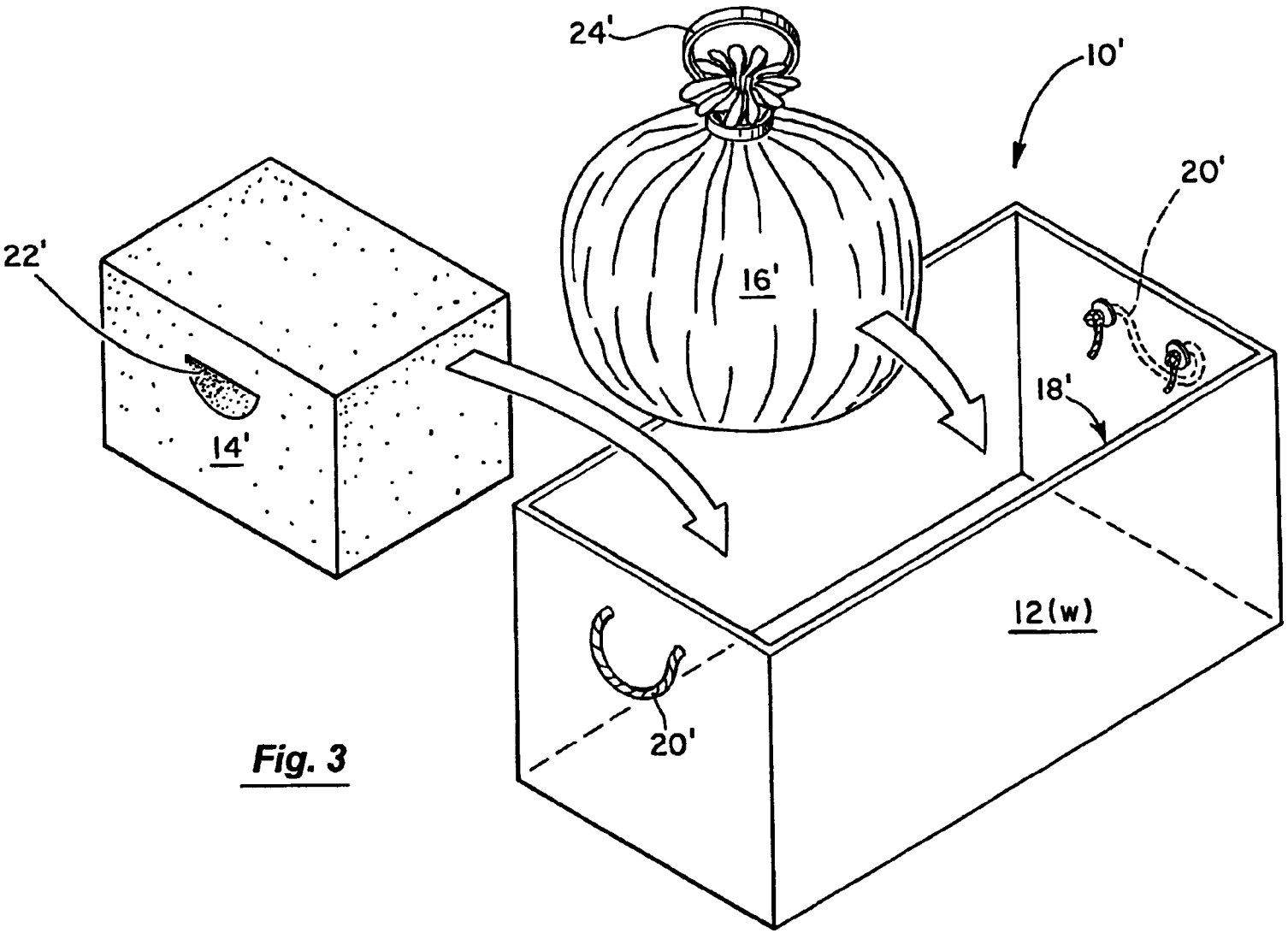
FIG. 3 is a perspective view of an embodiment of this invention wherein a block of asphaltic material and a container of aggregate material are placed in an outer container.

FIG. 3 depicts an alternative embodiment of this invention wherein an binder component of the system 10' is a single block of binder material such as an asphaltic and/or synthetic polymer material 14'. Such a block 14' may be provided with handles 22' to facilitate manual lifting thereof. Such a block 14' may be (but need not be) covered by a layer of sheet-like packaging material. Here again, in some of the more preferred embodiments of this invention, such a layer of sheet-like packaging material will be meltable under those melter unit heat conditions used to create the final form of the road surface, or bridge connector, repair composition. The outer container 12(W) shown in FIG. 3 is shown provided with another handle system 20' that is preferably made of a meltable polymeric material. However, in those cases where the outer container 12(W) is made of a non-meltable material (e.g., cardboard) that is to be disposed of as trash (rather than melted in the melter unit) the handles can be made of non-meltable materials.

Figure 4:
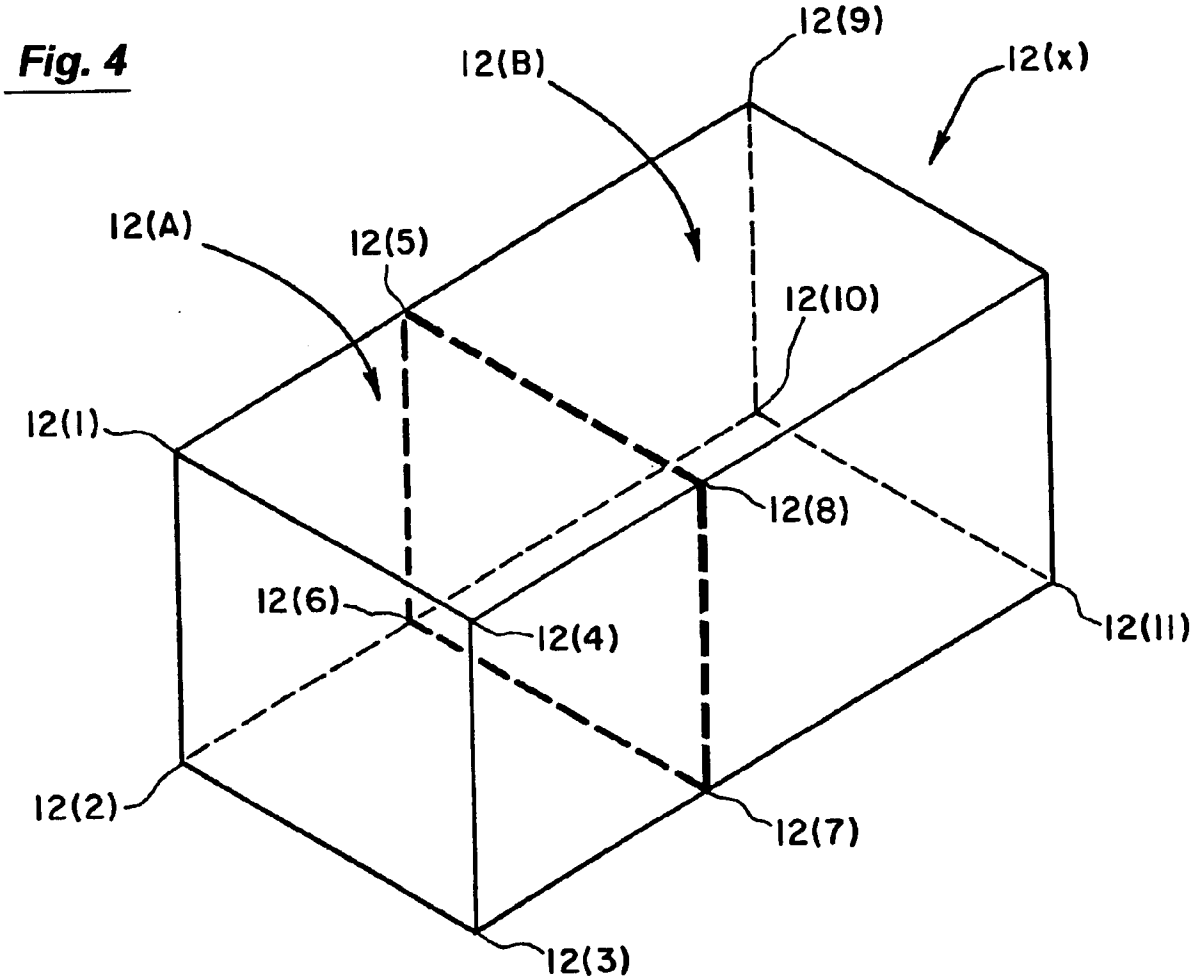
FIG. 4 is a perspective view of an embodiment of this invention wherein an outside container is comprised of a first inner container (containing an asphaltic material) and a second inner container (containing an aggregate material) and a container dividing device.

FIG. 4 depicts a container system wherein an outside container 12(X) is comprised of two components 12(A) and 12(B) that comprise a single unit for purposes of shipping and handling. That is to say the two components 12(A) and 12(B) are joined together as a unit. The first component 12(A) can, for example, contain a binder component (not otherwise shown) while the second component 12(B) contains an aggregate component (otherwise not shown). The two components 12(A) and 12(B) are shown joined at an interface plane 12(5), 12(6), 12(7) and 12(8). That is to say that the right side of the 12(A) component abuts against (and is joined with) the left side of the 12(B) component. The container 12 is preferably provided with a separation-aiding device such as deep lines of perforation 12(5) to 12(6), 12(6) to 12(7), 12(7) to 12(B) and 12(8) to 12(5). In another embodiment of this packaging system, the interface between the right side of the 12(A) component and the left side of the 12(B) component are affixed to each other by a layer of glue which is such that the two components 12(A) and 12(B) can be separated from each other at a job site, so that a binder component contained in component 12(A), can be placed in a melter unit independent of an aggregate material contained in component 12(B). In some of the more preferred embodiments of this invention, both a container for components 12(A) and 12(B) will be made of a meltable polymeric material.

Figure 5:
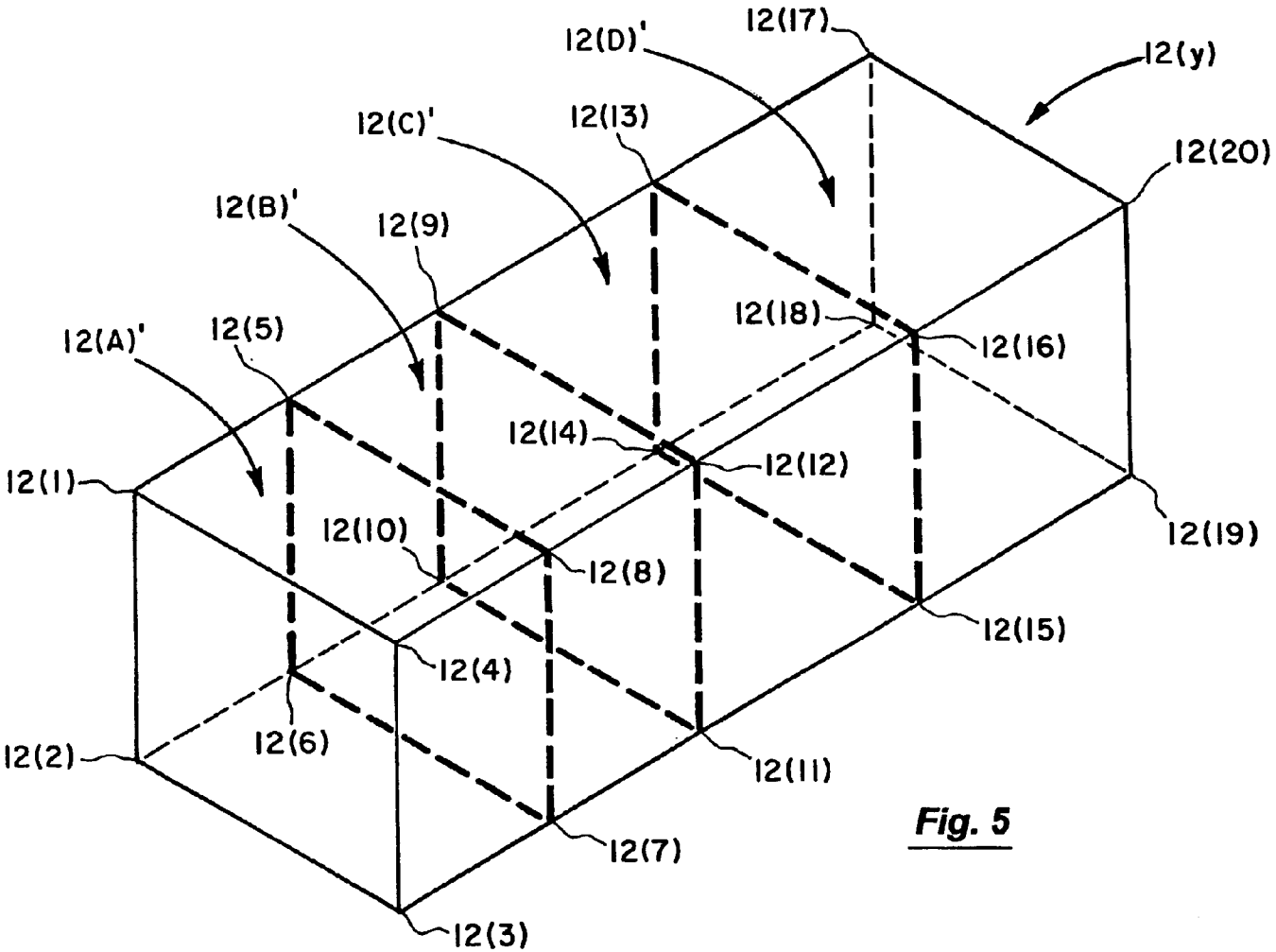
FIG. 5 is a perspective view of an embodiment of this invention wherein an outside container is comprised of two containers of asphaltic material and two containers of aggregate material and further provided with container dividing devices.

FIG. 5 depicts a container system wherein an outside container 12(Y) is comprised of two first components 12(A)' and 12(B)' and two second components 12(C') and 12(D'). Together all four of these components comprise a single unit for purposes of shipping and handling. The first two components 12(A)' and 12(B)' can, for example, contain an binder component (not otherwise shown) while the second two components 12(C)' and 12(D)' contain an aggregate component (otherwise not shown). In FIG. 5 components 12(A)' and 12(B)' are shown joined at an interface plane 12(5), 12(6), 12(7) and 12(8). That is to say that the right side of the 12(A)' component abuts against (and is joined with) the left side of the 12(B)' component. Similarly components 12(B)' and 12(C)' are joined at interface 12(9), 12(10), 12(11) and 12(12) while components 12(C)' and 12(D)' are joined at interface 12(13), 12(14), 12(15) and 12(16). The outside container is preferably provided with a separation-aiding device at each of these interfaces so that the asphaltic components those e.g., contained in container component 12(A)' and 12(B)', can be placed in a melter unit independent of the aggregate material contained in components 12(C)' and 12(D)'.

Figure 6:
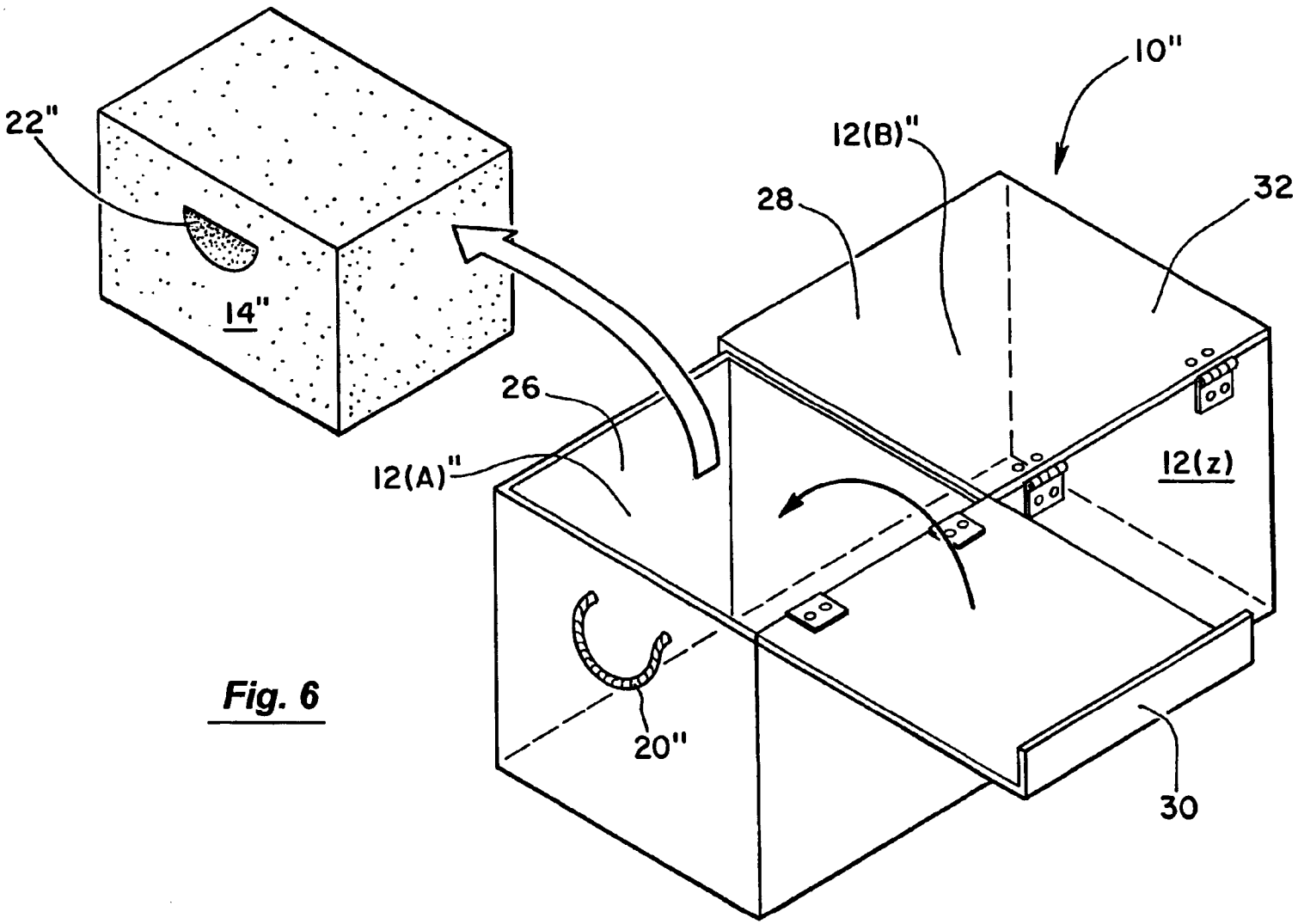
FIG. 6 is a perspective view of an embodiment of this invention wherein an outside container is comprised of two separate inner containers that each are provided with a lid.

FIG. 6 depicts an embodiment of this invention wherein an outside container 12(Z) is comprised of two separate inner containers 12(A)" and 12(B)". In effect the outside container 12(Z) defines two separate and distinct void spaces 26 and 28 that are each provided with respective lids 30 and 32. In the embodiment shown in FIG. 6, a block of binder material 14" (having a handle indentation 22") is shown being removed from void space 26. Thus, this block of binder material 14" can be separately removed from the outside container 12(Z) and placed in a melter unit. Thereafter, the aggregate contents of the second void space 12(B)" can be put into the jobsite melter. If the outside container 12(Z) were made of a meltable material, the entire container and its contents (contained in void spaces 26 and 28) could be placed in a melter unit. If the outer container 12(Z) is made of a non-meltable material, the lid 32 for the 12(B)" side of the container 12(Z) could be opened and its aggregate contents emptied into a melter. In this case these aggregate ingredients could be in a loose form in the 12(B)" inner container or they could be in another container such as a meltable bag or box.

Figure 7:
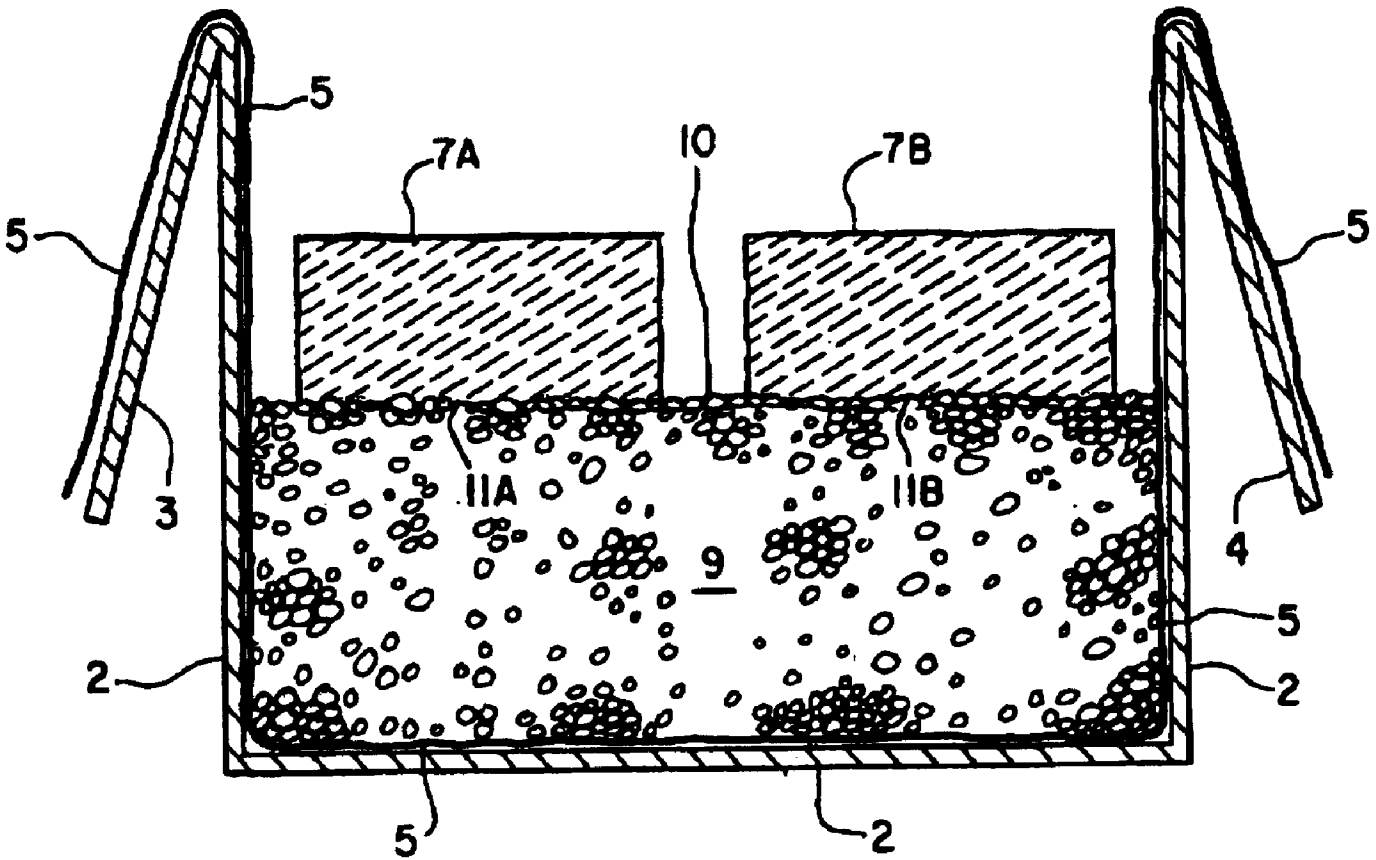
FIG. 7 is a cut-away side view of an embodiment of this invention wherein two solid blocks of binder are shown residing on top of a body of aggregate.

FIG. 7 depicts a road or bridge joint repair kit made according to the teachings of this invention wherein two distinct solid blocks of binder material 7A and 7B have been placed upon a body of aggregate particles 9 in a meltable bag 5 that is, in turn, contained in an outside container 2 such as one made of cardboard, meltable polymer material, wood box (having top flaps 3 and 4). Since the blocks of binder 7A and 7B were in a substantially solid state when they were placed on the top surface 10 of the body of aggregate 9, the respective interfaces 11A and 11B between the bottom of the blocks and the top surface 10 of the aggregate body are relatively sharp and clearly defined (i.e., the aggregate particles forming the top 10 of the aggregate body do not penetrate very far into the binder material).

Figure 8:
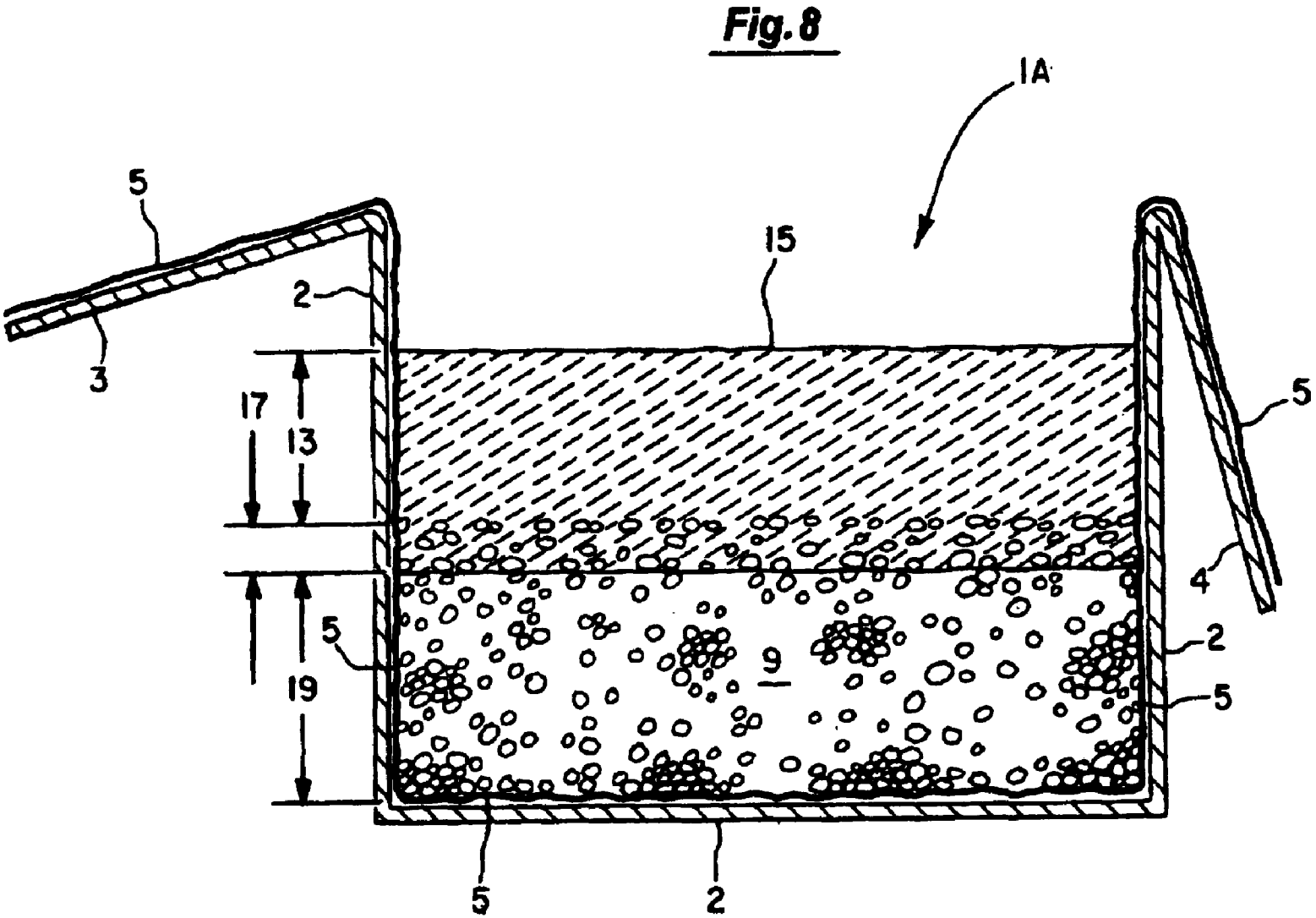
FIG. 8 is a cut-away side view of an embodiment of this invention wherein a liquid or semi-liquid binder has been poured over a body of aggregate and allowed to harden. This results in a layer of relatively pure binder, a layer of relatively pure aggregate and a layer of binder coated, mixed and/or immersed aggregate particles sandwiched between the aggregate layer and the binder layer.

FIG. 8 depicts a kit formed by pouring a liquid or semi-liquid binder 15 over a body of aggregate 9. The liquid or semi-liquid binder will penetrate into the top layer(s) of aggregate particles. In effect, the liquid binder will coat and/or immerse some/all of the top layer(s) of aggregate particles. After the binder cools (and hence hardens) the kit will have (1) a volume 13 of binder 15 that is not mixed with any substantial amount of aggregate particles; (2) a volume 17 of binder 15 that coats, immerses and is generally mixed with some of the uppermost aggregate particles; and (3) a volume 19 of aggregate particles that are not coated, immersed or generally mixed with the binder material 15 to any significant degree. Preferably, the volume of binder material that coats, immerses, etc. the uppermost aggregate particles is less than 40% (and most preferably less than 10%) of the total binder material in the kit.

Here again, particularly preferred kits of this patent disclosure will comprises (1) an outer container made from a meltable and hence "consumable" composition comprising a binder material (such as one comprised of an asphaltic material and at least one synthetic polymer), and wherein said outer container has a structure comprising a first box-like component that contains a binder material, a second box-like container that contains an aggregate material and a container breakage device such as indentations, notches, perforations glued together abutting faces or break channels extending around a parameter of the outer container so that the breakage device can serve to divide the outer container into two or more portions. Such a consumable asphalt-polymer container is preferably made by injection-molding. The outer container end walls may also include horizontal handhold portions. Preferably, any meltable outer containers used in the practice of this invention will be comprised of asphalt/polymer compositions comprising, by weight, from about 50% to about 80% of an asphalt material and from about 20% to about 50% of a polymer material.

In general, the synthetic polymer materials used in applicant's binder compositions and/or the meltable containers of this patent disclosure are made of polymers (or mixtures of polymers) that are compatible with an asphaltic component and that generally enables the outer container to have the desired physical properties (e.g., mechanical strength and meltability). Particularly preferred are those polymers selected from the group consisting of propylene, ethylene-propylene copolymers, and butylene copolymers. Copolymers of acrylates and methacrylates, such as butyl, propyl, ethyl, or methyl acrylate or methacrylate copolymerized with ethylene, propylene, or butylenes, can be used as well. One or more filler, modifier and/or reinforcing materials such as crushed stone, glass and other synthetic fibers, talc, calcium carbonate, silica or reclaimed materials also can be added to such asphalt/polymer compositions in concentrations from about 0.1 to about 15 weight percent of the overall asphalt/polymer/filler/modifier system.

A consumable (i.e., meltable) outer container for applicant's road or bridge joint repair systems preferably have walls with a thickness of about 0.25 inches, and may be formed by a process such as rotoforming, thermoforming, or injection molding. A given polymer material and/or another ingredient may advantageously enhance the properties of the asphaltic material for paving purposes, such as high-temperature performance as measured by, e.g., the Federal Highway Association's pending Strategic Highway Research Program (SHRP) specification, when the materials comprising the system is melted. Exemplary polymers for improving asphalt paving properties are ethylene vinyl acetate, ethylene-malic anhydride copolymers and polypropylene. The composition of the outer containers also may optionally include one or more fillers, such as organic or inorganic fibers.

EXAMPLE I

A road repair composition for the practice of this invention would be comprised of (1) from about 18 to about 90 weight percent (wt. %) asphaltic material, (2) from about 2 to 24 wt. % synthetic elastomers and/or polymers and (3) from about 5 to 50 weight synthetic and naturally occurring modifier materials such as clays (e.g., kalinite), diatomaceous earth, calcium carbonate and fiber may be part of the system. Relatively small amounts (e.g., 5–10 wt. %) antioxidants such as carbon black-sulfur also may be employed. A preferred specification relating to the physical properties of the binder portion of such a composition (and the ASTM test method used to test that property) are given in Table I.

TABLE I

| Property | Test Method | Typical Specification |
|---|---|---|
| Cone Pen @ 25 C | ASTM D-5329 | 90 Maximum |
| Resilience @ 25 C | ASTM D-5329 | 25% Minimum |
| Softening Point | ASTM D-36 | 175 Deg. F. Minimum |
| Flow @ 60 C | ASTM D-5329 | 3 MM Maximum |
| Curing Time | Moving Traffic | 30 Minutes Maximum |

EXAMPLE II

Another typical asphaltic material for a road repair composition would be comprised of about (1) 30 to about 70 weight percent (wt. %) asphaltic material, (2) from about 2 to about 18 wt. % synthetic elastomers or polymers and (3) from about 6 to about 40 wt. % percent modifiers and antioxidants. The physical properties and specifications relating to the binder portion of this composition (and the ASTM test for that property) are given in the following Table II.

TABLE II

| Property | Test Method | Typical Specification |
|---|---|---|
| Cone Pen @ 50 C | ASTM D-5329 | 90 Maximum |
| Flow @ 70 C | ASTM D-5329 | 5 MM Maximum |
| Softening Point | ASTM D-5329 | 180 Deg. F. Minimum |

A preferred bridge joint repair composition would be comprised of: (1) 40–70 weight percent asphaltic material, (2) 3–20 weight percent polymers or elastomers and (3) 10–20 weight percent synthetic or natural occurring modifiers. The remainder of the system would be an aggregate material that comprised from about 15 to about 75 percent of the overall aggregate/asphaltic material system. A typical specification relating to the physical properties of the binder portion (and ASTM test methods) of such a bridge joint repair composition are given in the following Table III:

TABLE III

| Property | Test Method | Typical Specification |
|---|---|---|
| Penetration @ 25 C | ASTM D-5329 | 90 Maximum |
| Flow @ 60 C | ASTM D-5329 | 3 MM Maximum |
| Softening Point | ASTM D-36 | 180 Deg. F. Minimum |
| Resilience | ASTM D-5329 | 30 Minimum |

Although the preceding disclosure sets forth a number of embodiments of the present invention, those skilled in this art will well appreciate that other arrangements or embodiments, not precisely set forth in the specifications of this patent disclosure, could be practiced under the teachings of the present invention. Therefore, the scope of this invention should only be limited by the scope of the following claims.

Thus having disclosed my invention, what is claimed is:

1. A road surface repair kit comprising:

(1) an outside container that houses a binder component and an aggregate component, (2) a premeasured amount of said binder component that is housed within the outside container, (3) a premeasured amount of said aggregate component that is housed within the outside container, and (4) an inner container that resides inside of the outside container and contains the premeasured amount of the binder component and the premeasured amount of the aggregate component in a substantially unmixed state such that at least 60% of the binder component is not mixed with the aggregate component and wherein the inner container is made of meltable polymeric material.

2. A bridge joint repair kit comprising:

(1) an outside container that houses a binder component and an aggregate component, (2) a premeasured amount of said binder component that is housed within the outside container, (3) a premeasured amount of said aggregate component that is housed within the outside container, and (4) an inner container that resides inside of the outside container and contains the premeasured amount of the binder component and the premeasured amount of the aggregate component in a substantially unmixed state such that at least 60% of the binder component is not mixed with the aggregate component and wherein the inner container is made of meltable polymeric material.

3. A road surface repair kit comprising:

(1) a premeasured amount of an aggregate body housed in an outside meltable polymeric container, said body having a top surface, (2) a premeasured amount of binder component heated to a fluid state and poured over said top surface of said aggregate body, and being allowed to solidify, (3) said binder component forming a first volume that is not mixed with any substantial amount of said aggregate body, and forming a second volume that coats and immerses said top surface of said aggregate body, and leaving a portion of said aggregate body not coated or immersed with said binder component to any significant degree, (3) a meltable polymeric inner container that contains said aggregate body and said binder component, and (4) said meltable polymeric material outside container containing said meltable polymeric inner container.

4. A bridge joint repair kit comprising:

(1) a premeasured amount of an aggregate body housed in an outside meltable polymeric container, said body having a top surface, (2) a premeasured amount of binder component heated to a fluid state and poured over said top surface of said aggregate body, and being allowed to solidify, (3) said binder component forming a first volume that is not mixed with any substantial amount of said aggregate body, and forming a second volume that coats and immerses said top surface of said aggregate body, and leaving a portion of said aggregate body not coated or immersed with said binder component to any significant degree, (3) a meltable polymeric inner container that contains said aggregate body and said binder component, and (4) said meltable polymeric material outside container containing said meltable polymeric inner container.

* * * * *